US006154883A

United States Patent [19]

Spann et al.

[11] Patent Number: 6,154,883

[45] Date of Patent: Dec. 5, 2000

[54] GARMENT FOR WEAR FOLLOWING THORACIC SURGERY

[75] Inventors: James D. Spann; Theresa H. Young; David T. Young, all of Alexander City, Ala.

[73] Assignee: THY Enterprises, Inc., Alexander City, Ala.

[21] Appl. No.: 09/112,734

[22] Filed: Jul. 9, 1998

[51] Int. Cl.[7] ..... A41B 1/00

[52] U.S. Cl. ..... 2/69; 2/114

[58] Field of Search ..... 2/114, 115, 113, 2/69, 80, 83, 73, 125, 77, 78.1; 450/1, 30, 36

[56] References Cited

U.S. PATENT DOCUMENTS

| | | | |
|---|---|---|---|
| D. 382,687 | 8/1997 | Schaffner | D2/703 |
| 2,707,284 | 5/1955 | Artzt | 2/243 |
| 3,521,301 | 7/1970 | Cowen | 2/114 |
| 3,574,864 | 4/1971 | Bradley | 2/114 |
| 3,873,999 | 4/1975 | Artzt | 2/113 |
| 4,058,874 | 11/1977 | Hausner | 28/153 |
| 4,100,621 | 7/1978 | Ettipio | 2/114 |
| 4,259,749 | 4/1981 | Krug et al. | 2/244 |
| 4,314,569 | 2/1982 | Speno | 128/425 |
| 4,363,144 | 12/1982 | Goad | 3/36 |
| 4,378,805 | 4/1983 | Reichert et al. | 128/450 |
| 4,412,542 | 11/1983 | Reichert | 128/455 |
| 4,473,908 | 10/1984 | Knecht | 2/115 |
| 4,587,671 | 5/1986 | Rodriguez, Jr. et al. | 2/69 |
| 4,637,398 | 1/1987 | Sherwood | 128/478 |
| 4,699,144 | 10/1987 | Sherwood | 450/54 |
| 4,737,995 | 4/1988 | Wiley | 2/114 |
| 4,764,986 | 8/1988 | Stewart | 2/115 |
| 4,781,650 | 11/1988 | Budd | 450/55 |
| 4,854,915 | 8/1989 | Luedy | 450/31 |
| 5,158,541 | 10/1992 | McCurley | 602/79 |
| 5,171,182 | 12/1992 | Heinen | 450/74 |
| 5,180,326 | 1/1993 | Williams | 450/91 |
| 5,553,323 | 9/1996 | Chou et al. | 2/14 |
| 5,564,123 | 10/1996 | Grassick | 2/69 |

*Primary Examiner*—John J. Calvert
*Assistant Examiner*—Alissa L. Hoey
*Attorney, Agent, or Firm*—Carr & Storm, L.L.P.; Jack D. Stine, Jr.

[57] ABSTRACT

A garment designed to be worn about the torso of a wearer, wherein the garment is made from a fabric cut according to a pattern having a plurality of edges which are joined together to form at least one seam on a first side of the garment, a seamless second side of the garment, two arm openings through which the wearer's arms may extend, and a neck opening through which the wearer's neck may extend.

12 Claims, 3 Drawing Sheets

GARMENT FOR WEAR FOLLOWING THORACIC SURGERY

FIELD OF THE INVENTION

The invention relates generally to garments and, more particularly, to undergarments designed to be comfortably worn following thoracic surgery.

BACKGROUND OF THE INVENTION

Thoracic surgery includes many types of surgery that may be performed on a person between the person's neck and waist. Thoracic surgery is thus performed when one has a mastectomy, open heart surgery, liepectomy, abdominal surgery, lymph node removal, or the like. Following such surgery, a person is left with zones of sensitivity such as the surgical wound site and scars that are sensitive to many sources of irritation. One common source of irritation occurs when seams in clothing rub against such zones of sensitivity. Another source of irritation occurs when clothing made from materials having a relatively rough texture rubs against such zones of sensitivity, such materials including cotton, polyester, cotton/polyester blends, silk, knitted or fleeced wool or wool blends. Irritation is compounded when clothing having a rough texture also has seams that rub against zones of sensitivity, and/or when the clothing absorbs and retains moisture.

Therefore, what is needed is a garment that may be worn by persons following thoracic surgery without irritating the area of scarring where the surgery was performed.

SUMMARY OF THE INVENTION

According to the present invention, a garment which provides comfort to wearers following thoracic surgery is made from a fabric cut according to a pattern having a plurality of edges which are joined together to form at least one seam on a first side of the garment, a seamless second side of the garment, two arm openings through which the wearer's arms may extend, and a neck opening through which the wearer's neck may extend.

DESCRIPTION OF THE PREFERRED EMBODIMENTS

Figure 1A:
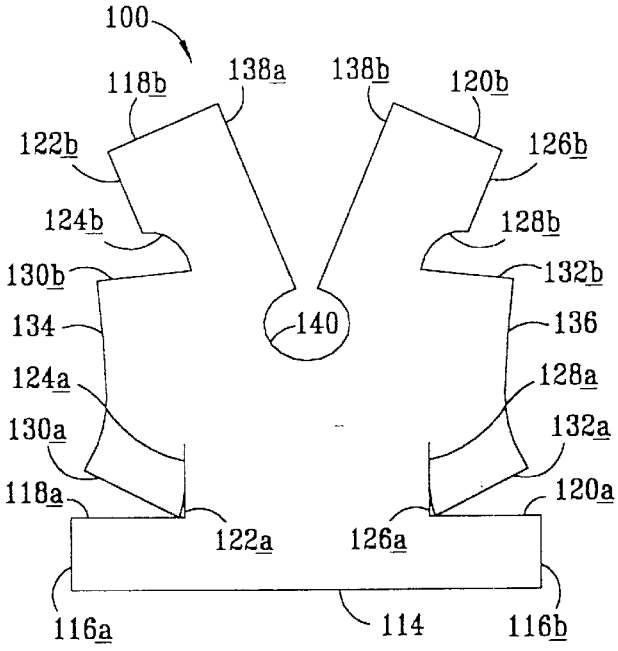
FIG. 1A is plan view of a pattern of cloth used to form a garment in accordance with the present invention.

In the discussion of the Figures, reference numerals appended with either a letter "a" or a letter "b" will designate corresponding edges of a fabric pattern which are to be sewn together to form a seam when assembled. The appended "a" or "b" will be removed from a numeral when referring to the seam formed when two corresponding edges having the same numeral are sewn together.

Referring to FIGS. 1A–1D of the drawings, the reference numeral 100 generally designates a pattern of cloth configured to form a garment, described below, in accordance with the present invention. The pattern of cloth 100 is formed from a single piece of fabric cut substantially according to the pattern shown in FIG. 1A. The pattern of cloth 100 preferably comprises a fabric such as polypropylene, supplied by Poly-Pro, L.L.C., located in Chattanooga, Tenn., or any suitable knitted or woven fabric, such as silk, very fine cotton, very fine denier filament, microfiber yarn, microfiber polyester, microdenier polyester, Antron® nylon, polyethylene, or the like, which provides a wearer with a high degree of comfort, softness, and wicking action for wicking moisture away from a wearer. Such fabric would preferably also be odor-resistant, stain resistant, would not pill, would be relatively lightweight (e.g., less than 5 ounces per square yard), and would not be translucent. Fabric may also be selected for providing thermal insulation.

As viewed in FIG. 1A, the pattern of cloth 100 is defined by a plurality of edges, including a generally horizontal straight bottom edge 114 which extends between two generally upwardly extending straight edges 116*a* and 116*b*. Extending from the edge 116*a*, the left side of the cloth 100, as viewed in FIG. 1A, is generally defined, in the sequence given, by a horizontal inwardly extending straight edge 118*a*, an upwardly extending straight edge 122*a*, a downwardly and slightly outwardly extending convex edge 124*a*, an upwardly and outwardly extending straight edge 130*a*, an upwardly extending concave edge 134, an inwardly and slightly upwardly extending straight edge 130*b*, an upwardly and outwardly extending concave edge 124*b*, an upwardly and outwardly extending straight edge 122*b*, an upwardly and inwardly extending straight edge 118*b*, a downwardly and inwardly extending straight edge 138*a*, and a semicircular concave edge 140. Similarly, extending from the edge 116*a*, the right side of the cloth 102, as viewed in FIG. 1A, is generally defined, in the sequence given, by a horizontal inwardly extending straight edge 120*a*, an upwardly extending straight edge 126*a*, a downwardly and slightly outwardly extending convex edge 128*a*, a upwardly and outwardly extending straight edge 132*a*, a upwardly extending concave edge 136, a inwardly and slightly upwardly extending straight edge 132*b*, an upwardly and outwardly extending concave edge 128*b*, an upwardly and outwardly extending straight edge 126*b*, an upwardly and inwardly extending straight edge 120*b*, a downwardly and inwardly extending straight edge 138*b*, and the semicircular concave edge 140.

Figure 1B:
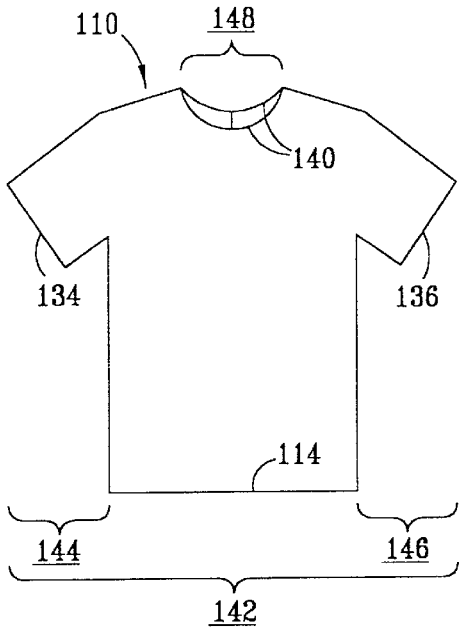
FIG. 1B is a front elevational view of a garment assembled from the pattern of cloth depicted in FIG. 1A.
Figure 1D:
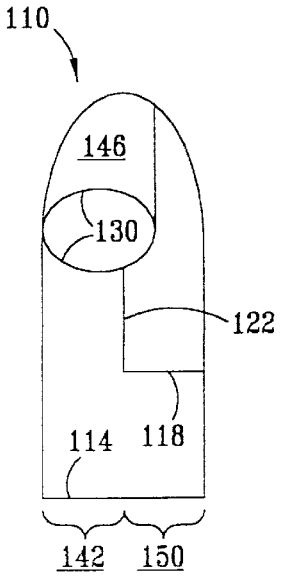
FIG. 1D is a side elevational view of the garment of FIG. 1C taken along the line 1D—1D of FIG. 1C.
Figure 1C:
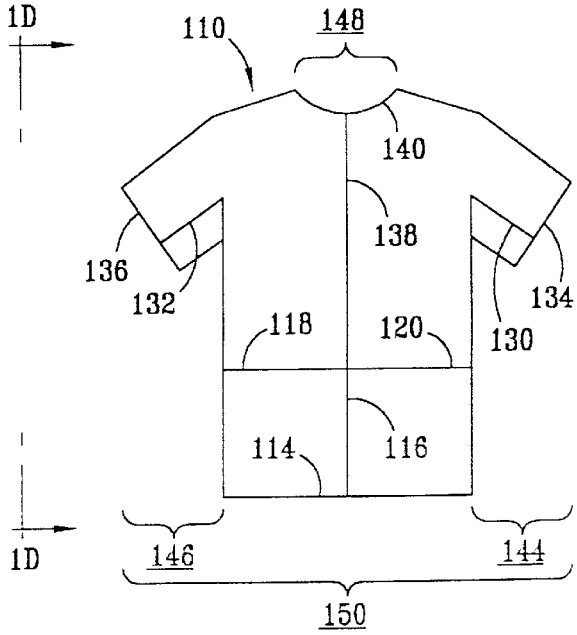
FIG. 1C is a rear elevational view of the garment of FIG. 1B.

The cloth 100 is assembled into a garment 110, shown in FIGS. 1B–1D, by joining together via suitable seams the edge 116*a* to the edge 116*b*, the edge 118*a* to the edge 118*b*, the edge 120*a* to the edge 120*b*, the edge 122*a* to the edge 122*b*, the edge 124*a* to the edge 124*b*, the edge 126*a* to the edge 126*b*, the edge 128*a* to the edge 128*b*, the edge 130*a* to the edge 130*b*, the edge 132*a* to the edge 132*b*, and the edge 138*a* to the edge 138*b*. The foregoing edges are joined together using suitable seams, such as, for example, flat seams, well know to those skilled in the art. The edges 114, 134, 136, and 140 are not joined to another edge, but rather are hemmed together using a conventional hem such as a single needle cover seam, well know to those skilled in the art.

Upon assembly, the garment 110 forms a tee-shirt-like garment as shown in FIGS. 1B–1D. A front view of the assembled garment 110 in FIG. 1B depicts the garment having a front portion 142, including two sleeve portions 144 and 146, a neck opening 148 defined by the edge 140, and hemmed edges 114, 134, 136, and 140. A rear view of the assembled garment 110 shown in FIG. 1C depicts the garment having a rear portion 150, the two sleeve portions 144 and 146, the neck opening 148, hemmed edges 114, 134, 136, and 140, and seams 116, 118, 120, 130, 132, and 138. A side view of the assembled garment 110 in FIG. 1D, taken along the line 1D—1D of FIG. 1C, shows the front portion 142, the rear portion 150, the sleeve portion 146, the seam 118, the seam 122 extending partially down the side of the garment, and the hem 136.

The assembled garment 110 may be worn by itself or as an undergarment by a wearer (not shown) following thoracic surgery much as a conventional tee-shirt is worn, wherein the head and neck of a wearer pass through the neck opening 148, and the arms of the wearer pass through the sleeve portions 144 and 146. In contrast to a conventional tee-shirt which includes seams between the sleeves and the front and rear portions of the tee-shirt and along each entire side of the tee-shirt, the garment 110, as shown in FIG. 1B, does not have any seams on the front portion 142 of the garment, and along only a portion of the side of the garment. This feature, whereby the garment 110 is assembled without any seams on the front of the garment, permits the garment to be worn more comfortably than conventional tee-shirts by wearers who have experienced thoracic surgery. Additionally, by also using cloth, such as polypropylene described above, to fabricate the tee-shirt, maximum comfort is afforded the wearer. Therefore, irritation by the seams and texture of a garment to zones of sensitivity incurred by a wearer following thoracic surgery is minimized.

Figure 2A:
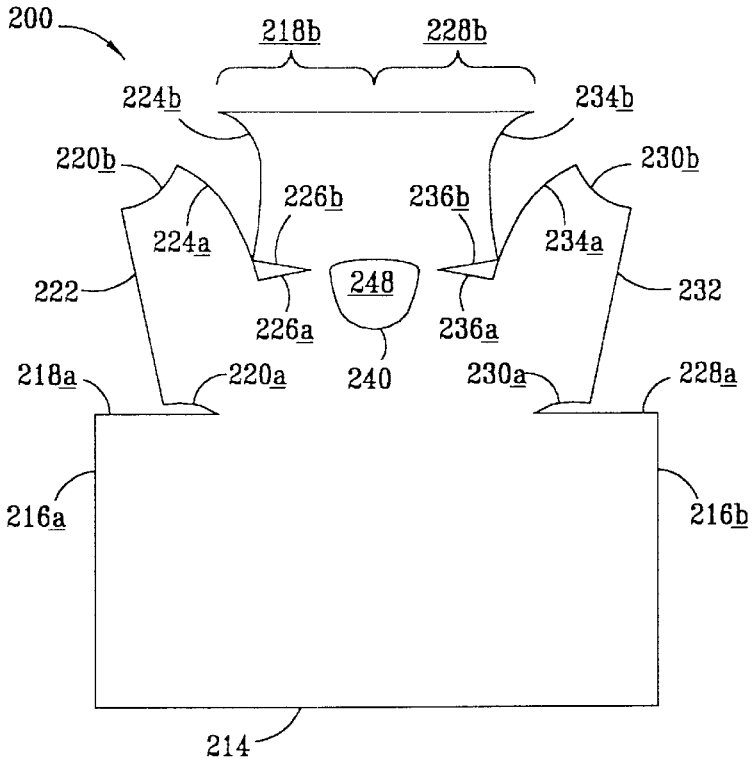
FIG. 2A is plan view of a first alternate pattern of cloth used to form a garment in accordance with the present invention.
Figure 2B:
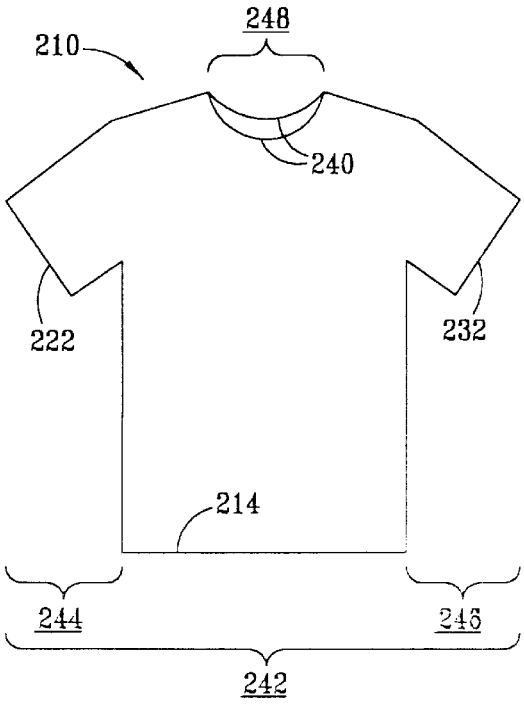
FIG. 2B is a front elevational view of a garment assembled from the pattern of cloth depicted in FIG. 2A.
Figure 2C:
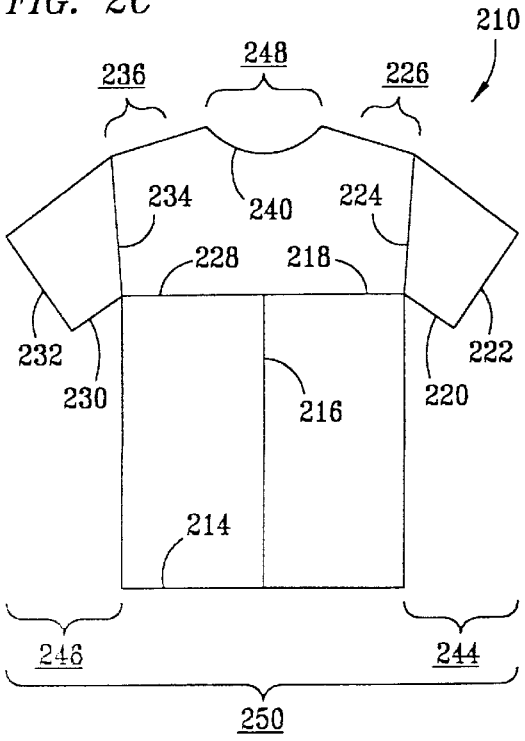
FIG. 2C is a rear elevational view of the garment of FIG. 2B.

Referring to FIGS. 2A–2C of the drawings, the reference numeral 200 generally designates a pattern of cloth configured to form a garment, described below, in accordance with an alternate embodiment of the present invention. The pattern of cloth 200 is formed from a single piece of cloth cut substantially as shown in FIG. 2A from a suitable fabric, such as polypropylene, similar to the fabric used to fabricate the pattern of cloth 100 described above.

As viewed in FIG. 2A, the pattern of cloth 200 is defined by a plurality of edges, including a flat bottom edge 214 which extends generally horizontally between two generally upwardly extending upwardly extending straight edges 216*a* and 216*b*. Extending from the edge 216*a*, the left side of the cloth 200, as viewed in FIG. 2A, is generally defined in the sequence given by a horizontal inwardly extending straight edge 218*a*, an outwardly extending horizontal concave edge 220*a*, an upwardly and outwardly extending straight edge 222, an upwardly and inwardly extending concave edge 220*b*, a downwardly and inwardly extending convex edge 224*a*, a slightly upwardly and inwardly extending straight edge 226*a*, a slightly upwardly and outwardly extending straight edge 226*b*, an upwardly and outwardly extending concave edge 224*b*, and a flat horizontal straight edge 218*b*. Similarly, extending from the edge 216*b*, the right side of the cloth, as viewed in FIG. 2A, is generally defined in the sequence given by a horizontal inwardly extending straight edge 228*a*, an outwardly extending horizontal concave edge 230*a*, an upwardly and outwardly extending straight edge 232, an upwardly and inwardly extending concave edge 230*b*, a downwardly and inwardly extending convex edge 234*a*, a slightly upwardly and inwardly extending straight edge 236*a*, a slightly upwardly and outwardly extending straight edge 236*b*, an upwardly and outwardly extending concave edge 234*b*, and a flat horizontal straight edge 228*b*.

The cloth 200 is assembled into a garment 210, shown in FIGS. 2B–2C, by joining together via suitable seams the edge 216*a* to the edge 216*b*, the edge 218*a* to the edge 218*b*, the edge 220*a* to the edge 220*b*, the edge 224*a* to the edge 224*b*, the edge 228*a* to the edge 228*b*, the edge 230*a* to the edge 230*b*, and the edge 234*a* to the edge 234*b*. The foregoing edges are joined together using suitable seams, such as, for example, flat seams, well know to those skilled in the art. The edges 214, 222, and 232 are not joined to another edge, but rather are hemmed together sing a conventional hem such as a single needle cover seam, well know to those skilled in the art.

Upon assembly, the garment 210 forms a tee-shirt-like garment as shown in FIGS. 2B and 2C. A front view of the assembled garment 210 in FIG. 2B depicts a front portion 242 of the garment, the front portion including two sleeve portions 244 and 246, the neck opening 248 defined by the edge 240, and hemmed edges 214, 222, 232, and 240. A rear view of the assembled garment 210 in FIG. 2C depicts a rear portion 250 of the garment including two sleeve portions 244 and 246, the neck opening 248, hemmed edges 214, 222, 232, and 240, and seams 216, 218, 228, 220, 230, 224, and 234. As shown in FIG. 2C, seams 220 and 230 are located on the under side of the sleeve portions 244 and 246, respectively, and seams 226 and 236 are located on a top portion of the garment 210.

The assembled garment 210 may be worn by itself or as an undergarment by a wearer (not shown) following thoracic surgery much as a conventional tee-shirt is worn, wherein the head and neck of a wearer pass through the neck opening 248, and the arms of the wearer pass through the sleeve portions 244 and 246. In contrast to a conventional tee-shirt which includes seams between the sleeves and the front and rear portions of the tee-shirt and along each side of the tee-shirt, the garment 210, as shown in FIG. 2B, does not have any seams on the front portion 242 or the side of the garment. This feature, whereby the garment 210 is assembled without any seams on the front of the garment, permits the garment 210 to be worn more comfortably than conventional tee-shirts by wearers who have experienced thoracic surgery. Additionally, by also using cloth, such as polypropylene described above, to fabricate the tee-shirt, maximum comfort is afforded the wearer. Therefore, irritation by the seams and texture of a garment to zones of sensitivity incurred by a wearer following thoracic surgery is minimized.

Figure 3A:
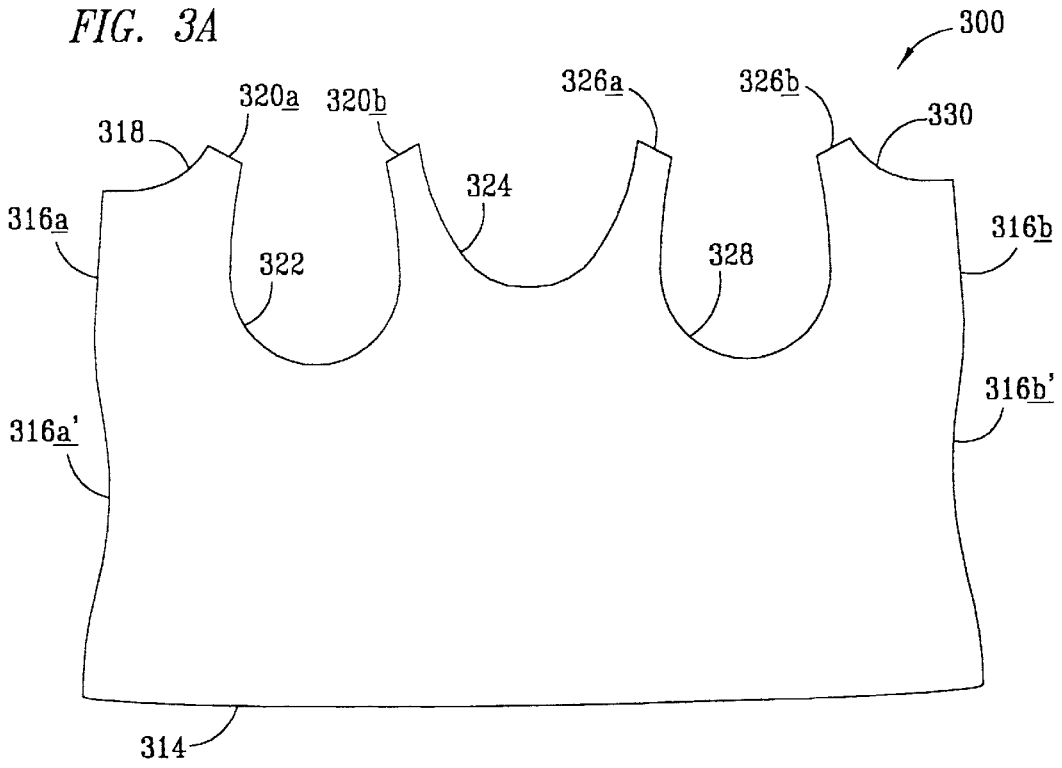
FIG. 3A is plan view of a second alternate pattern of cloth configured to form a garment in accordance with the present invention.
Figure 3B:
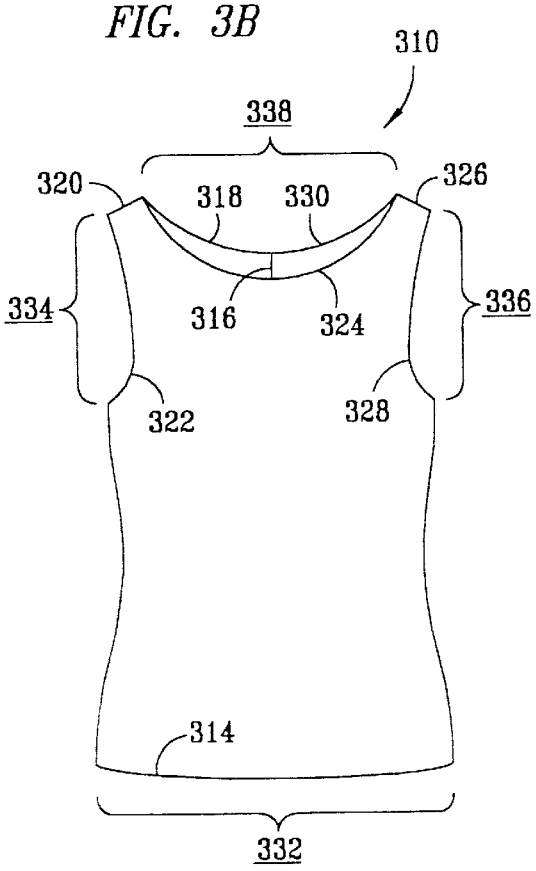
FIG. 3B is a front elevational view of a garment assembled from the pattern of cloth depicted in FIG. 3A.
Figure 3C:
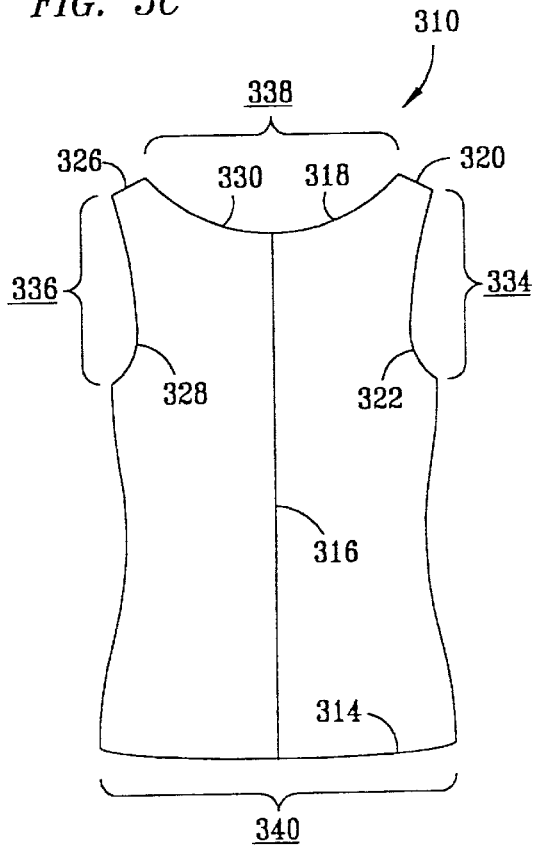
FIG. 3C is a rear elevational view of the garment of FIG. 3B.

Referring to FIGS. 3A–3C of the drawings, the reference numeral 300 generally designates a pattern of cloth configured to form a garment, described below, in accordance with yet another alternate embodiment of the present invention. The pattern of cloth 300 is formed from a single piece of cloth cut substantially as shown in FIG. 3A from a suitable fabric, such as polypropylene, similar to the fabric used to fabricate the pattern of cloth 100 described above.

As viewed in FIG. 3A, the pattern of cloth 300 is defined by a plurality of edges, including a generally flat bottom edge 314 which extends horizontally across the lower side of the garment between two generally upwardly extending edges 316*a* and 316*b*, having concave portions 316*a*′ and 316*b*′ formed therein. Extending generally across the top side of the garment, from the edge 316*a* to the edge 316*b*, are an arcuate concave edge 318, a straight edge 320*a*, and arcuate concave edge 322, a straight edge 320*b*, an arcuate concave edge 324, a straight edge 326*a*, an arcuate concave edge 328, a straight edge 326*a*, and an arcuate concave edge 330.

The cloth 300 is assembled into a garment 310, shown in FIGS. 3B–3C, by joining together via suitable seams the edge 316*a* to the edge 316*b*, the edge 320*a* to the edge 320*b*, and the edge 326*a* to the edge 326*b*. The foregoing edges are joined together using suitable seams, such as, for example, flat seams, well know to those skilled in the art. The edges 314, 318, 322, 324, 328, and 330 are not joined to another edge, but rather are hemmed together using a conventional hem such as a single needle cover seam, well know to those skilled in the art.

Upon assembly, the garment 310 forms a camisole-like garment as shown in FIGS. 3B and 3C. A front view of the assembled garment 310 in FIG. 3B shows the hemmed edges 314, 318, 322, 324, 328, and 330, and depicts the garment having a front portion 332, arm openings 334 and 336, and a neck opening 338. A rear view of the assembled garment 310 in FIG. 3C shows hemmed edges 314, 318, 322, 328, and 330, seams 316, 326, and 320, the two sleeve openings 334 and 336, the neck opening 338, and a rear portion 340.

The assembled garment 310 may be worn by itself or as an undergarment by a wearer (not shown) following thoracic surgery much as a conventional camisole is worn, wherein the head and neck of a wearer pass through the neck opening 338, and the arms of the wearer pass through the arm openings 334 and 336. In contrast to a conventional camisole, the garment 310, as shown in FIG. 1B, does not have any seams on the front portion 332 or sides of the garment. This feature, whereby the garment 310 is assembled without any seams on the front or sides of the garment, permits the garment to be worn more comfortably than conventional camisoles by wearers who have experienced thoracic surgery. Additionally, by also using cloth, such as polypropylene described above, to fabricate the camisole, maximum comfort is afforded the wearer. Therefore, irritation by the seams and texture of a garment to zones of sensitivity incurred by a wearer following thoracic surgery is minimized.

It is understood that the present invention can take many forms and embodiments. Accordingly, several variations may be made in the foregoing without departing from the spirit or the scope of the invention. For example, rather than using flat seams and conventional hems, edges of the garments 110, 210, and 310 may be joined or hemmed together using Velcro™, a zipper, an ultrasonic seam, a conventional sewn seam, a thermal seam, overlap stitching, or the like. Multiple pieces of fabric may used to fabricate the foregoing garments provided that the front sides of the garments are seamless; for example, in FIG. 2A, the edges 226*a* and 236*a* in the pattern of cloth 200 may be extended to the neck opening 248, thereby partitioning the pattern of cloth 200 into two pieces of fabric, yet still providing for a garment having a seamless front and side portions. Darts may be formed in the garments provided they are not located where they are prone to irritate a wearer's zone of sensitivity. The garments described herein may be modified for wearers who have had back surgery so that seams are positioned in the front and not in the back of the garment, thereby rendering the back of the garments seamless so that they do not irritate zones of sensitivity on located on a wearer's back. The garment may be worn by anyone who desires a comfortable garment, even if such a wearer has not had any thoracic surgery.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly it is appropriate that the appended claims be construed broadly and in a manner consistent with the scope of the invention.

Having thus described the invention, what is claimed is:

1. A method for assembling a garment configured to be worn about the torso of a wearer, the method comprising the steps of:

a) cutting from a piece of fabric a pattern that may be oriented to generally define an exterior perimeter by:

a horizontal straight $1^{st}$ edge having a first end and a second end;

a straight $2^{nd}$ edge which extends upwardly from the first end of the $1^{st}$ edge to an end of the $2^{nd}$ edge;

a straight $3^{rd}$ edge which extends horizontally and inwardly from the end of the $2^{nd}$ edge to an end of the $3^{rd}$ edge;

a straight $4^{th}$ edge which extends upwardly from the end of the $3^{rd}$ edge to an end of the $4^{th}$ edge;

a convex $5^{th}$ edge which extends downwardly from the end of the $4^{th}$ edge to an end of the $5^{th}$ edge;

a straight $6^{th}$ edge which extends upwardly and outwardly from the end of the $5^{th}$ edge to an end of the $6^{th}$ edge;

a concave $7^{th}$ edge which extends upwardly from the end of the $6^{th}$ edge to an end of the $7^{th}$ edge;

a straight $8^{th}$ edge which extends inwardly from the end of the $7^{th}$ edge to an end of the $8^{th}$ edge;

a concave $9^{th}$ edge which extends upwardly and outwardly from the end of the $8^{th}$ edge to an end of the $9^{th}$ edge;

a straight $10^{th}$ edge which extends upwardly and outwardly from the end of the $9^{th}$ edge to an end of the $10^{th}$ edge;

a straight $11^{th}$ edge which extends upwardly and inwardly from the end of the $10^{th}$ edge to an end of the $11^{th}$ edge;

a straight $12^{th}$ edge which extends downwardly and inwardly from the end of the $11^{th}$ edge to an end of the $12^{th}$ edge;

a semicircular concave $13^{th}$ edge which extends from the end of the $12^{th}$ edge to an end of the $13^{th}$ edge;

a straight $14^{th}$ edge which extends upwardly from the second end of the $1^{st}$ edge to an end of the $14^{th}$ edge;

a straight $15^{th}$ edge which extends horizontally and inwardly from the end of the $14^{th}$ edge to an end of the $15^{th}$ edge;

a straight $16^{th}$ edge which extends upwardly from the end of the $15^{th}$ edge to an end of the $16^{th}$ edge;

a convex $17^{th}$ edge which extends downwardly from the end of the $16^{th}$ edge to an end of the $17^{th}$ edge;

a straight $18^{th}$ edge which extends upwardly and outwardly from the end of the $17^{th}$ edge to an end of the $18^{th}$ edge;

a concave $19^{th}$ edge which extends upwardly from the end of the $18^{th}$ edge to an end of the $19^{th}$ edge;

a straight $20^{th}$ edge which extends inwardly and upwardly from the end of the $19^{th}$ edge to an end of the $20^{th}$ edge;

a concave $21^{st}$ edge which extends upwardly and outwardly from the end of the $20^{th}$ edge to an end of the $21^{st}$ edge;

a straight $22^{nd}$ edge which extends upwardly and outwardly from the end of the $21^{st}$ edge to an end of the $22^{nd}$ edge;

a straight $23^{rd}$ edge which extends upwardly and inwardly from the $22^{nd}$ edge to an end of the $23^{rd}$ edge; and a straight $24^{th}$ edge which extends downwardly and inwardly from the end of the $23^{rd}$ edge to the end of the $13^{th}$ edge; and b) securing together the edges to form a garment having at least one seam on a first side of the garment, a substantially seamless second side of the garment, two arm openings through which a wearer's arms may extend, and a neck opening through which the wearer's neck may extend, by:

securing together the $2^{nd}$ and $24^{th}$ edges;
securing together the $3^{rd}$ and $11^{th}$ edges;
securing together the $4^{th}$ and $10^{th}$ edges;
securing together the $5^{th}$ and $9^{th}$ edges;
securing together the $12^{th}$ and $14^{th}$ edges;
securing together the $15^{th}$ and $23^{rd}$ edges;
securing together the $16^{th}$ and $22^{nd}$ edges;
securing together the $17^{th}$ and $21^{st}$ edges; and
securing together the $18^{th}$ and $20^{th}$ edges.

2. The method of claim 1 wherein the piece of fabric is a single piece of fabric.

3. The garment of claim 1 wherein the fabric is selected from a group of fabrics consisting substantially of polypropylene, polyethylene, silk, cotton, microfiber polyester, microdenure polyester, and Antron™ nylon.

4. The garment of claim 1 wherein the steps of securing together further comprise securing together substantially using one of Velcro™, a zipper, an ultrasonic seam, a sewn seam, a thermal seal, and an overlap stitch.

5. A method for assembling a garment configured to be worn about the torso of a wearer, the method comprising the steps of:

a) cutting from a piece of fabric a pattern having and interior opening and which piece of fabric may be oriented to have an exterior perimeter generally defined by:

a horizontal straight $1^{st}$ edge having a first end and a second end;

a straight $2^{nd}$ edge which extends upwardly from the first end of the $1^{st}$ edge to an end of the $2^{nd}$ edge;

a straight $3^{rd}$ edge which extends horizontally and inwardly from the end of the $2^{nd}$ edge to an end of the $3^{rd}$ edge;

a concave $4^{th}$ edge which extends outwardly from the end of the $3^{rd}$ edge to an end of the $4^{th}$ edge;

a straight $5^{th}$ edge which extends upwardly and outwardly from the end of the $4^{th}$ edge to an end of the $5^{th}$ edge;

a concave $6^{th}$ edge which extends upwardly and inwardly from the end of the $5^{th}$ edge to an end of the $6^{th}$ edge;

a convex $7^{th}$ edge which extends downwardly from the end of the $6^{th}$ edge to an end of the $7^{th}$ edge;

a straight $8^{th}$ edge which extends inwardly from the end of the $7^{th}$ edge to an end of the $8^{th}$ edge;

a straight $9^{th}$ edge which extends outwardly from the end of the $8^{th}$ edge to an end of the $9^{th}$ edge;

a concave $10^{th}$ edge which extends upwardly from the end of the $9^{th}$ edge to an end of the $10^{th}$ edge;

a straight $11^{th}$ edge which extends horizontally from the end of the $10^{th}$ edge to an end of the $11^{th}$ edge;

a straight $12^{th}$ edge which extends upwardly from the second end of the $1^{st}$ edge to an end of the $12^{th}$ edge;

a straight $13^{th}$ edge which extends horizontally and inwardly from the end of the $12^{th}$ edge to an end of the $13^{th}$ edge;

a concave $14^{th}$ edge which extends outwardly from the end of the $13^{th}$ edge to an end of the $14^{th}$ edge;

a straight $15^{th}$ edge which extends upwardly from the end of the $14^{th}$ edge to an end of the $15^{th}$ edge;

a concave $16^{th}$ edge which extends upwardly and inwardly from the end of the $15^{th}$ edge to an end of the $16^{th}$ edge;

a convex $17^{th}$ edge which extends downwardly from the end of the $16^{th}$ edge to an end of the $17^{th}$ edge;

a straight $18^{th}$ edge which extends inwardly from the end of the $17^{th}$ edge to an end of the $18^{th}$ edge;

a straight $19^{th}$ edge which extends outwardly from the end of the $18^{th}$ edge to an end of the $19^{th}$ edge;

a concave $20^{th}$ edge which extends upwardly from the end of the $19^{th}$ edge to an end of the $20^{th}$ edge;

a straight $21^{st}$ edge which extends horizontally from an the end of the $20^{th}$ edge to the end of the $11^{th}$ edge; and b) securing together the edges to form a garment having at least one seam on a first side of the garment, a substantially seamless second side of the garment, two arm openings through which a wearer's arms may extend, and a neck opening through which the wearer's neck may extend, by:

securing together the $2^{nd}$ and $12^{th}$ edges;
securing together the $3^{rd}$ and $11^{th}$ edges;
securing together the $4^{th}$ and $6^{th}$ edges;
securing together the $7^{th}$ and $10^{th}$ edges;
securing together the $8^{th}$ and $9^{th}$ edges;
securing together the $13^{th}$ and $21^{st}$ edges;
securing together the $14^{th}$ and $16^{th}$ edges;
securing together the $17^{th}$ and $20^{th}$ edges; and
securing together the $18^{th}$ and $19^{th}$ edges.

6. The method of claim 5 wherein the piece of fabric is a single piece of fabric.

7. The garment of claim 5 wherein the fabric is selected from a group of fabrics consisting substantially of polypropylene, polyethylene, silk, cotton, microfiber polyester, microdenure polyester, and Antron™ nylon.

8. The garment of claim 5 wherein the steps of securing together further comprise securing together substantially using one of Velcro™, a zipper, an ultrasonic seam, a sewn seam, a thermal seal, and an overlap stitch.

9. A method for assembling a garment configured to be worn about the torso of a wearer, the method comprising the steps of:

a) cutting from a piece of fabric a pattern which may be oriented to have an exterior perimeter generally defined by:

a horizontal straight $1^{st}$ edge having a first end and a second end;

a $2^{nd}$ edge which extends upwardly from the first end of the $1^{st}$ edge to an end of the $2^{nd}$ edge;

an arcuate concave $3^{rd}$ edge which extends upwardly and inwardly from the end of the $2^{nd}$ edge to an end of the $3^{rd}$ edge;

a straight $4^{th}$ edge which extends from the end of the $3^{rd}$ edge to an end of the $4^{th}$ edge;

an arcuate concave $5^{th}$ edge which extends downwardly, over, and upwardly from the end of the $4^{th}$ edge to an end of the $5^{th}$ edge;

a straight $6^{th}$ edge which extends from the end of the $5^{th}$ edge to an end of the $6^{th}$ edge;

an arcuate concave $7^{th}$ edge which extends downwardly, over, and upwardly from the end of the $6^{th}$ edge to an end of the $7^{th}$ edge;

a straight $8^{th}$ edge which extends from the end of the $7^{th}$ edge to an end of the $8^{th}$ edge;

an arcuate concave $9^{th}$ edge which extends downwardly, over, and upwardly from the end of the $8^{th}$ edge to an end of the $9^{th}$ edge;

a straight $10^{th}$ edge which extends from the end of the $9^{th}$ edge to an end of the $10^{th}$ edge;

an arcuate $11^{th}$ edge which extends downwardly and outwardly from the end of the $10^{th}$ edge to an end of the $11^{th}$ edge; and a $12^{th}$ edge which extends downwardly from the end of the $11^{th}$ edge to an end of the $12^{th}$ edge; and b) securing together the edges to form a garment having at least one seam on a first side of the garment, a substantially seamless second side of the garment, two arm openings through which a wearer's arms may extend, and a neck opening through which the wearer's neck may extend, by:

securing together the $2^{nd}$ and $12^{th}$ edges;

securing together the $4^{th}$ and $6^{th}$ edges; and securing together the $8^{th}$ and $10^{th}$ edges.

10. The method of claim 9 wherein the piece of fabric is a single piece of fabric.

11. The garment of claim 9 wherein the fabric is selected from a group of fabrics consisting substantially of polypropylene, polyethylene, silk, cotton, microfiber polyester, microdenure polyester, and Antron™ nylon.

12. The garment of claim 9 wherein the steps of securing together further comprise securing together substantially using one of Velcro™, a zipper, an ultrasonic seam, a sewn seam, a thermal seal, and an overlap stitch.

* * * * *

UNITED STATES PATENT AND TRADEMARK OFFICE

CERTIFICATE OF CORRECTION

PATENT NO. : 6,154,883
DATED : December 5, 2000
INVENTOR(S) : Spann et al.

It is certified that error appears in the above-identified patent and that said Letters Patent is hereby corrected as shown below:

Title page,
*Attorney, Agent or Firm*, delete "Stine" insert -- Stone --

Column 2,
Line 46, delete "102" insert -- 100 --

Column 4,
Line 16, delete "sing" insert -- using --

Column 5,
Line 47, delete "scams" insert -- seams --

Signed and Sealed this

Twenty-ninth Day of January, 2002

*Attest:*

*Attesting Officer*

JAMES E. ROGAN
*Director of the United States Patent and Trademark Office*